US008979573B1

(12) United States Patent
Barber et al.

(10) Patent No.: US 8,979,573 B1
(45) Date of Patent: Mar. 17, 2015

(54) CONNECTOR BLOCK WITH SPRING-LOADED ELECTRICAL TERMINAL ASSEMBLIES

(71) Applicant: Phoenix Contact Development and Manufacturing, Inc., Middletown, PA (US)

(72) Inventors: Terry Lee Barber, Harrisburg, PA (US); Michael Anthony Correll, Hershey, PA (US); Melissa Ann Sommer, Palmyra, PA (US)

(73) Assignee: Phoenix Contact Development and Manufacturing, Inc., Middletown, PA (US)

( * ) Notice: Subject to any disclaimer, the term of this patent is extended or adjusted under 35 U.S.C. 154(b) by 0 days.

(21) Appl. No.: 14/248,660

(22) Filed: Apr. 9, 2014

Related U.S. Application Data

(63) Continuation of application No. 13/630,264, filed on Sep. 28, 2012, now abandoned.

(51) Int. Cl.
*H01R 4/24* (2006.01)

(52) U.S. Cl.
USPC ..... 439/441; 439/835

(58) Field of Classification Search
USPC ..... 439/441, 835
See application file for complete search history.

(56) References Cited

U.S. PATENT DOCUMENTS

| | | | | |
|---|---|---|---|---|
| 4,846,722 | A | 7/1989 | Heng et al. | |
| 5,816,867 | A | 10/1998 | Davidsz et al. | |
| 6,146,217 | A | 11/2000 | Osada | |
| 6,183,311 | B1 | 2/2001 | Suess et al. | |
| 6,350,162 | B1 | 2/2002 | Despang | |
| 6,851,967 | B2 | 2/2005 | Miyoshi et al. | |
| 7,287,999 | B2 | 10/2007 | Holterhoff et al. | |
| 7,329,143 | B2 | 2/2008 | Schrader et al. | |
| 7,491,096 | B1 | 2/2009 | Correll | |
| 7,510,448 | B2 | 3/2009 | Eppe et al. | |
| 2006/0063420 | A1 | 3/2006 | Reibke et al. | |
| 2008/0286996 | A1 * | 11/2008 | Tuerschmann et al. | 439/152 |
| 2010/0081316 | A1 | 4/2010 | Eppe et al. | |
| 2011/0207372 | A1 * | 8/2011 | Breen, IV | 439/629 |

FOREIGN PATENT DOCUMENTS

| | | | |
|---|---|---|---|
| DE | 19534315 | C1 | 2/1997 |
| DE | 19741136 | A1 | 4/1999 |
| DE | 20205821 | U1 | 9/2003 |
| DE | 102004018904 | A1 | 11/2005 |
| DE | 202006009460 | U1 | 3/2007 |
| EP | 1100150 | B1 | 5/2001 |

OTHER PUBLICATIONS

Phoenix Contact, Drawing Document No. 00457127, PT 2,5 . . . , Jan. 17, 2012.

European Patent Office, International Search Report in corresponding PCT/EP2013/052556, May 28, 2013, 12 pages.

* cited by examiner

*Primary Examiner* — Gary Paumen
(74) *Attorney, Agent, or Firm* — Hooker & Habib, P.C.

(57) ABSTRACT

An electrical terminal or spring terminal for forming an electrical connection between a wire conductor and a current bar includes a spring and a spring retainer, the spring retainer not integral with the spring and not integral with the current bar. Engageable abutment surfaces on the spring retainer and the current bar cooperate to transfer spring force to the current bar.

24 Claims, 3 Drawing Sheets

CONNECTOR BLOCK WITH SPRING-LOADED ELECTRICAL TERMINAL ASSEMBLIES

FIELD OF THE DISCLOSURE

Disclosed are electrical terminal assemblies for forming electrical connections between wire conductors and rigid conductors, and in particular screwless electrical terminal assemblies in which a spring presses the wire conductor against the rigid conductor.

BACKGROUND OF THE DISCLOSURE

Connector blocks that include "screwless" electrical terminals or spring terminals for forming electrical connections between rigid conductors or current bars in the connector block and wire conductors are known. The spring terminal utilizes a compressed spring that generates a spring force pressing the wire conductor against the current bar to form the electrical connection therebetween.

A known type of spring terminal utilizes the current bar as a spring retainer. A portion of the current bar is formed as a spring retainer that retains both ends of the compressed spring. The current bar is made of expensive electrically conductive material (typically a copper alloy). Forming the spring retainer in the current bar is expensive both in material cost and manufacturing cost.

Another type of known spring terminal includes a spring in which the spring has a first leg that lies against one side of the current bar and an extension attached to a second leg, with an opening in the extension to receive the current bar. The second leg presses against the second side of the current bar to maintain the spring in the compressed condition. Manufacture and assembly of the spring with the current bar is relatively expensive.

Yet another known type of spring terminal the current bar extends along one wall of a rigid U-shaped member, the spring compressed between the other wall and the contact bar. In this type of spring terminal the U-shaped member effectively compresses the spring between the legs of the member. The U-shaped member is a relatively large component and so material cost is high.

Thus there is a need for a connector block having spring terminals that utilize a spring retainer that is not formed as part of the current bar, has relatively low cost, and is easier to assemble.

SUMMARY OF THE DISCLOSURE

Disclosed in one or more embodiments is a connector block having improved spring terminals that includes a spring retainer that is not formed as part of the current bar, is a relatively low cost member, and enables the spring terminal to be installed in the connector block at low cost.

A spring terminal includes a current bar, a spring retainer, and a spring, the spring retainer not integral with the current bar and not integral with the spring.

The spring includes first and second end portions, with the spring compressed between a first portion of the current bar and a first portion of the spring retainer, the first end portion of the spring in pressure contact with the first portion of the current bar and the second end portion of the spring in pressure contact with the first portion of the spring retainer. The spring urges the spring retainer in a first direction away from the first portion of the current bar.

The spring retainer includes a first abutment surface facing the first direction and the current bar includes a first abutment surface facing the first abutment surface of the spring retainer. The first abutment surface of the current bar is located to engage the first abutment surface of the spring retainer with movement of the spring retainer in the first direction whereby the first abutment surface of the current bar resists movement of the spring retainer urged by the spring away from the first portion of the current bar.

The spring retainer is preferably formed as a stamped member from metal plate. Because the spring retainer is not formed in the current bar, the spring retainer can be made from a low-cost material such as steel having better material properties to function as a spring retainer.

In a preferred embodiment, the first and second portions of the current bar are joined together by a ninety-degree bend. The second portion of the current bar includes a notch formed on a peripheral surface of the current bar that includes the abutment surface of the current bar. The spring retainer includes a flange that is closely received in the notch, the abutment surface of the spring retainer located on the flange surface facing the abutment surface of the current bar.

The spring terminal disclosed herein has a number of advantages. The spring retainer is a low-cost component with reduced manufacturing cost. Identical spring retainers can be used with connector blocks having multiple current bars with different bar geometries, simplifying and reducing inventory costs. The spring terminal is easy to assemble.

Other objects and features will become apparent as the description proceeds, especially when taken in conjunction with the accompanying drawing sheets.

DETAILED DESCRIPTION

Figure 1:
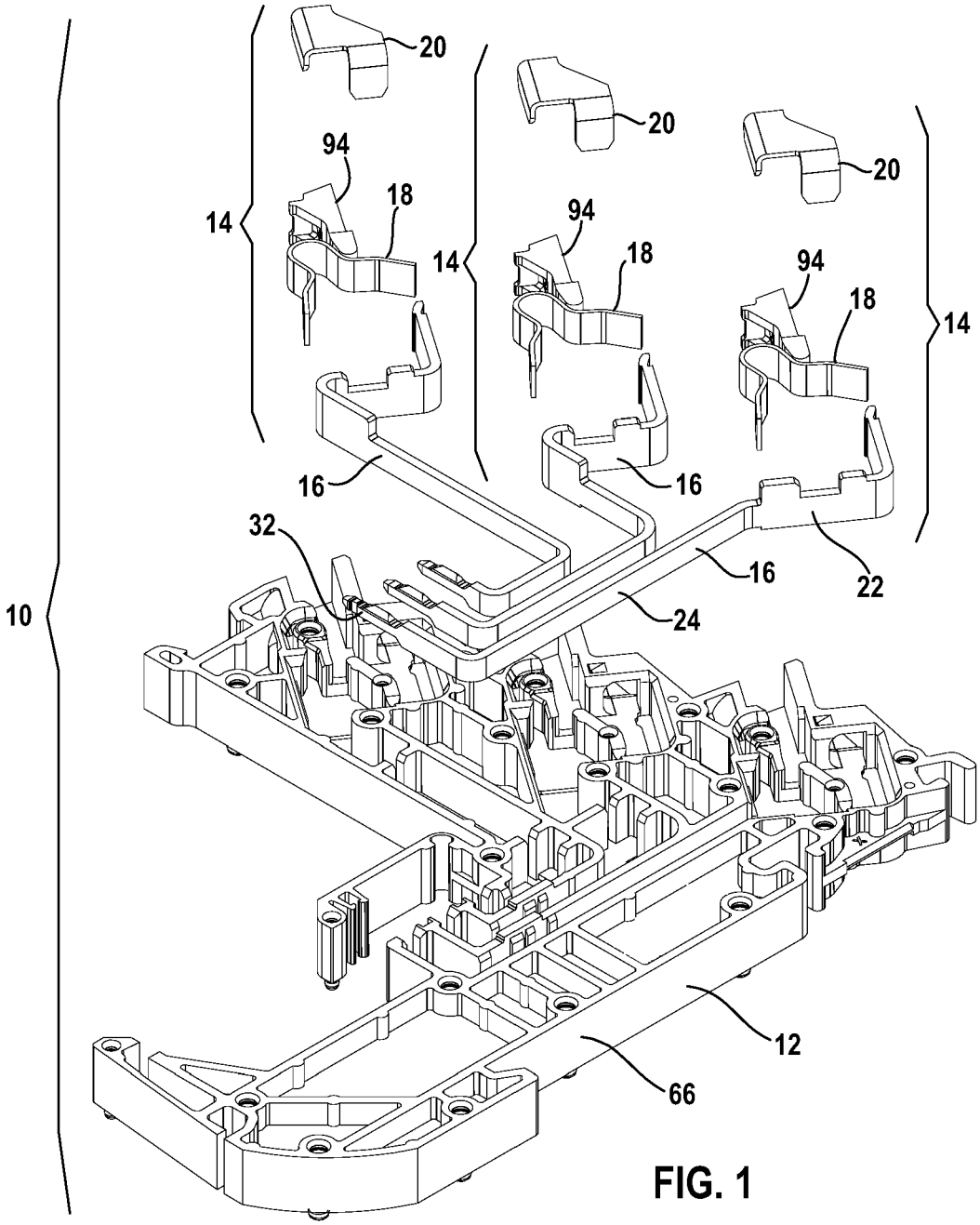
FIG. 1 is an exploded view of a connector block having spring terminal assemblies.
Figure 2:
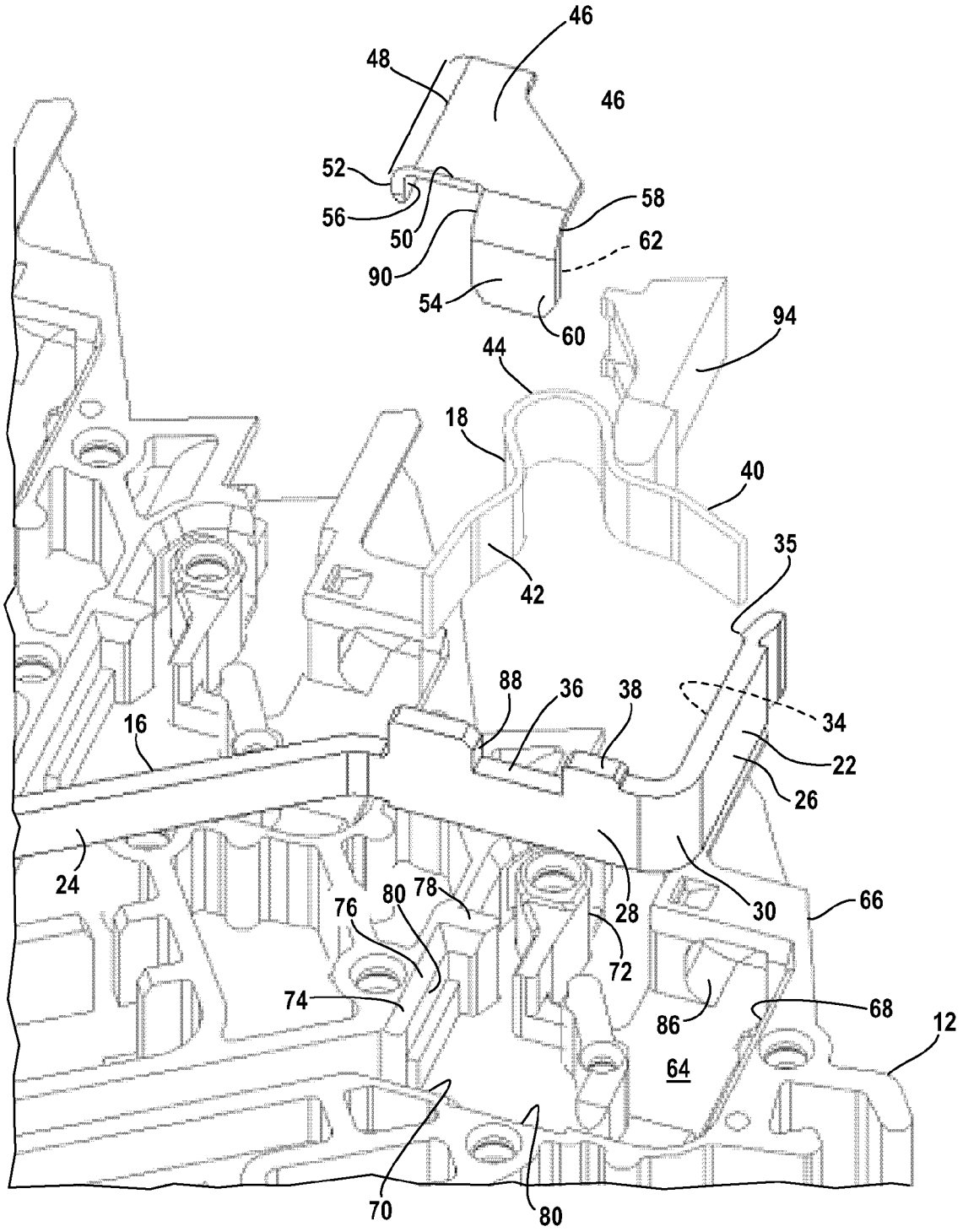
FIG. 2 is a closer, exploded view of one of the spring terminal assemblies shown in FIG. 1.

The figures illustrate a connector block 10 for forming electrical connections between wire conductors and current bars 16 carried by the connector block 10. The connector block 10 includes a housing 12 and a number of like electrical terminal or spring terminal assemblies 14 in the housing 12, each terminal assembly 14 configured to form an electrical connection between a wire conductor and a respective current bar 16. Because in the illustrated embodiment the terminal assemblies 14 are identical assemblies (although each of the current bars have different geometries), only a single terminal assembly will be described in detail.

The terminal assembly 14 includes an end portion of a conductor bar or current bar 16, a spring 18, and a support plate or spring retainer 20, the spring retainer 20 a body separate from and not integral with the current bar 16 or the spring 18. A respective pusher tool or actuator tool 94 is associated with each terminal assembly 14 and is used to open and close the terminal assembly 14 when inserting or removing a wire conductor.

The current bar 16 is an elongate and rigid electrically-conducting member having a generally rectangular cross-section. The current bar 16 has a terminal end portion 22 and a tail end portion 24. The terminal end portion 22 forms part of the terminal assembly 14 and includes a first, free end contact portion 26 and a second retention portion 28 joined to the contact portion 26 by a right-angle bend 30. The tail end portion 24 extends away from the retention portion 28 to a free end portion 32 configured for making an electrical connection with another circuit element. The illustrated tail end portion 24 is configured to electrically connect to a circuit board, and the tail end portion of each current bar of the conductor block has a different geometry. Other current bar geometries and configurations, including the tail end portion 24 itself forming part of another terminal assembly 14 are possible.

The conductor contact portion 26 has a flat contact surface 34, with a pawl or tooth 35 extending from the surface 34.

The conductor retention portion 28 has a through-opening 36 extending through the thickness of the current bar and spaced from the bend 30. The opening 36 is formed as a rectangular notch in an upper peripheral surface 38 of the retention portion 28.

The spring 18 is a V-spring or leaf-spring made from spring steel and has a first end portion or first leg 40 and a second end portion or second leg 42, the legs 40, 42 extending outwardly away from each other from an arcuate center spring portion 44

The spring retainer 20 is formed from relatively thin steel plate and includes a generally flat, triangular web 46 having a first side 48 and a second side 50, the sides 48, 50 defining a right angle, with first and second flanges 52, 54 extending in the same direction away from the web 46. The first flange 52 has a generally flat inner surface 56 that is perpendicular to the web 46. The second flange 54 has a curved upper flange portion 58 that bends away from the web 46 and a lower flange portion 60 that has a generally flat inner surface 62, the surface 62 perpendicular to the web 46 and also perpendicular to the first flange surface 56.

The housing 12 is made of or molded from a non-conductive material such as plastic resin as is known in the connector block art, and includes a side wall 64 closing a first side of the housing 12 and a peripheral wall 66 extending from the side wall to the second side of the housing, the peripheral wall 66 defining the interior of the housing 12. The housing 12 is configured to be a slice housing, that is, so configured that a number of housings 12 can be placed side-by-side and connected to adjacent housings 12 to form the connector block 10. An example of a connector block formed from a number of slice housings is disclosed in Correll, U.S. Pat. No. 7,491,096, and incorporated by reference as if fully set forth herein. In other embodiments the connector block 10 can be formed from a single housing 12.

The housing 12 has conventional walls, posts, and lugs extending from the sidewall 64 and the peripheral wall 66 to receive and support the current bars 16 in the housing 12 and to interconnect adjacent slice housings 12; these features are conventional and so will not be described herein. The housing 12 also includes structural elements associated with the terminal assemblies 14; each set is associated with a respective terminal assembly 14. A description of only one set of elements will be described below.

A "vertical" wall 68 and a "horizontal" wall 70 extend from the sidewall 64 and are configured to extend along and support the current bar conductor portion 26 and the retainer portion 28 respectively. A spring post 72 extends from the sidewall 64 and carries the center spring portion 44 to mount the spring 18 in the housing 12. An "L" shaped wall 74 extends from the sidewall 64 and is spaced from the sidewall 68. The leg 74 includes a "vertical" wall leg 76 parallel to and facing the vertical wall and a second, shorter "horizontal" wall leg 78 facing the horizontal wall 70.

The horizontal wall 70 includes a notch 80 formed on the inner side of the wall, the notch 80 sized and positioned to closely receive the spring retainer second flange 54. The vertical wall leg 76 includes a notch 82 formed on the inner side of the wall leg, the notch 82 sized and positioned to closely receive the spring retainer first flange 52. The upper ends of each notch 80, 82 have opposed tapered surfaces that assist in guiding the respective spring retainer flanges 52, 54 into the notch.

A tool opening 84 and a conductor wire opening 86 extend through the peripheral wall 66. The tool opening 84 is offset from the spring post 72 towards the vertical wall 68. The conductor wire opening 86 is aligned with the contact surface 34 of the current bar 14 so that a conductor wire inserted through the conductor opening 86 is immediately adjacent the contact surface 34.

Assembly and operation of the spring terminal 14 is described next. The current bar 14 is placed in the housing 12, with the terminal portion 22 extending along the vertical housing wall 68 and the retainer portion 28 extending along the horizontal housing wall 70. The spring 18 is compressed, placed on the spring post 72, and released. The spring 18 is configured such that upon release, the first spring leg 40 makes pressure contact with the current bar contact face 34 and the second spring leg 42 makes pressure contact with the vertical wall leg 76.

The spring retainer 20 is then installed by being placed over the current bar 18 with the first flange 52 over and aligned with the wall leg notch 82 and the second flange 54 over and aligned with the horizontal wall notch 80. The spring retainer 20 is then moved towards the housing 12, with the horizontal wall leg 78 assisting in the proper lateral positioning of the spring retainer 20 relative to the housing 12. As the flanges 52, 54 are received in the respective notches 82, 80 the first flange 52 moves into contact with the spring leg 42, moving the second spring leg 42 away from the wall leg 74 and causing the spring leg 42 to be in pressure contact with the first flange contact surface 56. In this way, the spring 18 is compressed between the current bar 14 and the first spring retainer flange 52, with the spring force applied by the leg 74 carried by the metal spring retainer 20 instead of by the resin wall leg 74.

When the spring retainer 20 is fully installed in the housing 12, the first spring retainer flange 52 is closely received in the vertical notch 82 and the second spring retainer flange 54 is closely received in the horizontal notch 84. The first flange contact surface 56 faces the current bar contact surface 34, and the spring 18 compressed between the two surfaces 56, 34. The second flange upper portion 58 extends through and is closely received in the slot or notch 36 of the current bar retainer portion 28, and the second flange lower portion 60 is closely received in the horizontal wall notch 80 and faces and extends along the outside of the current bar retainer portion 28.

The spring force generated by the spring 18 biases or urges the spring retainer 20 away from the current bar contact surface 34. The spring force also urges the second flange upper portion 58 towards the side of the notch 36 away from the contact surface 34. Because the upper flange portion 58 is closely received in the notch 36, the notch surface 88 facing the flange portion 58 and the flange surface 90 facing that side of the notch 80 form facing cooperating abutment surfaces. By curving the upper flange portion 58, the surface areas of the cooperating abutment surfaces 88, 90 are increased. The abutment surfaces 88, 90 are disposed to engage one another and resist movement of the spring retainer 20 away from the current bar contact surface 34. In this way, a portion of the spring force is transmitted from the spring retainer 20 to the current bar 16, reducing the force applied to the resin housing components to resist relative movement of the spring retainer 20. The second flange lower portion 60 further cooperates with the current bar 16 to resist twisting of the spring retainer 20 urged by the spring force.

Figure 3:
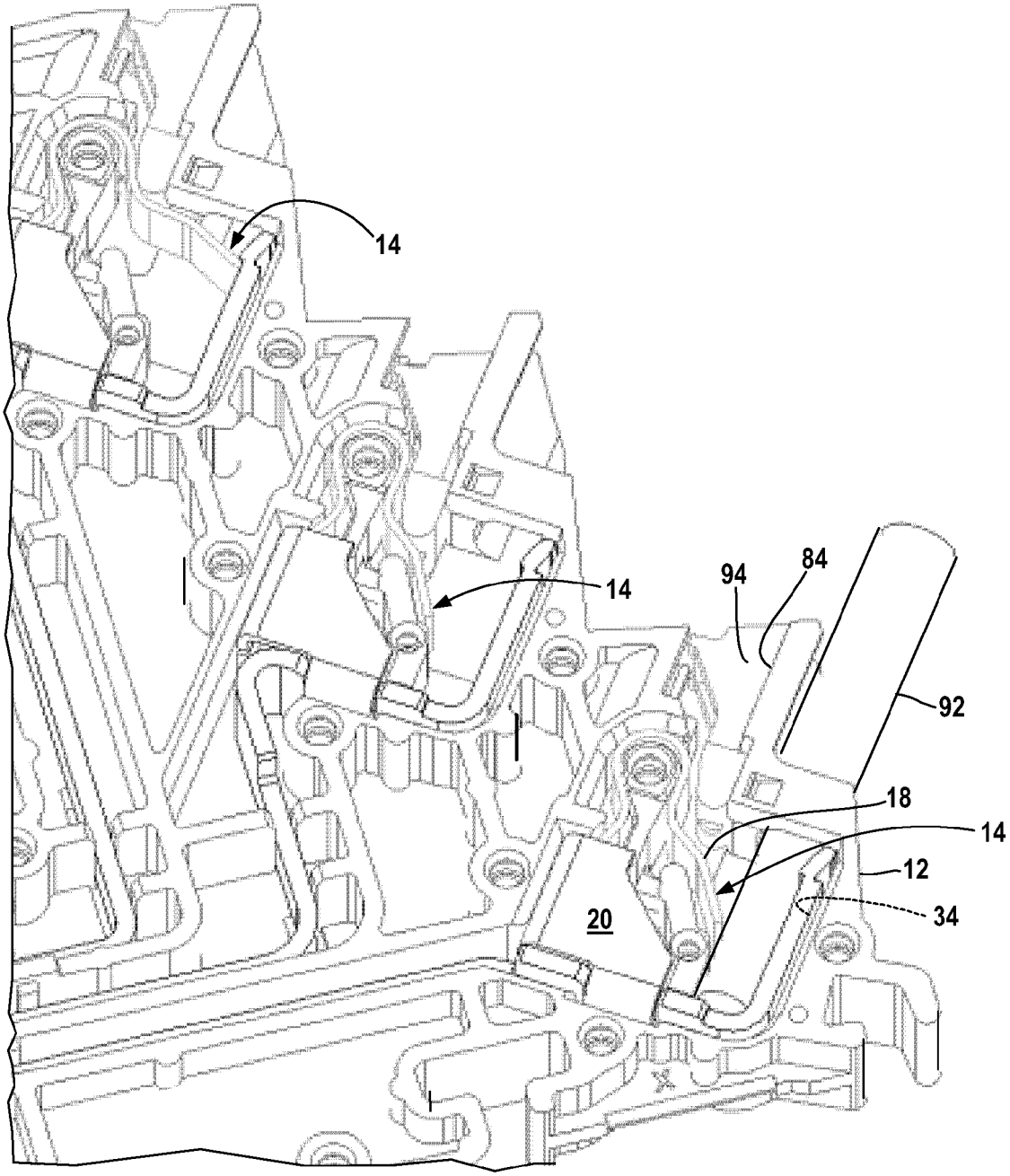
FIG. 3 is a view of the spring terminal assembly shown in FIG. 2 forming an electrical connection with a wire conductor.

The left-most terminal assembly 14 as viewed in FIG. 3 is shown prior to insertion of a wire conductor. The current bar pawl 35 acts as a stop cooperating to maintain compression of the spring. The tool 94 is normally retained with the housing 12 as shown in the drawing. To insert a wire conductor 92 into the terminal assembly 14 the tool 94 is pushed further into the housing 12 and further compresses the spring 18, deflecting the first spring leg 40 towards the first spring retainer flange 52 and spacing the spring 18 away from the current bar contact surface 34, thereby opening the terminal assembly 14.

The middle terminal assembly 14 as viewed in FIG. 3 illustrates the opened terminal assembly 14. The wire conductor 92 is then inserted through the conductor opening 86 and the tool 94 is withdrawn after the wire conductor is properly positioned in the housing 12, decompressing the spring 18 and closing the terminal assembly 14.

The right-most terminal assembly 14 as viewed in FIG. 3 illustrates a closed electrical terminal 14 forming an electrical connection with the wire conductor 92. The spring 18 presses the wire conductor 92 against the current bar contact surface 34 to form an electrical connection between the current bar 16 and the wire conductor 92, the pressure contact of the spring leg 40 against the current bar contact surface 34 transmitted through the wire conductor 92. Removal of the conductor wire 92 is essentially the reverse of insertion.

While the spring 18 is further compressed by the tool 94, additional spring force is applied to the spring retainer 20 urging the retainer 20 away from the current bar contact surface 34. This additional spring force is distributed by the abutment surfaces 88, 90 from the spring retainer 18 to the current bar 16 to reduce additional loading of the resin housing components by the additional spring compression.

In other embodiments, a connector block 10 could include only a single current bar 16, or could have a number of current bars 16 in which the current bar terminal portions 22 have varying geometries wherein each terminal assembly 14 utilizes a different-shaped spring 18 and/or a different-shaped spring retainer 20. In yet other possible embodiments the current bar retainer portion slot 36 could be formed as a through-hole totally surrounded by the current bar. In yet further possible embodiments the spring retainer upper flange portion 58 could fit in the slot 36 with clearance such that the engagement surfaces 88, 90 engage each other with movement of the spring retainer 20 away from the contact surface 34 only when the tool 92 is deflecting the spring 18, the vertical wall leg 74 supporting the spring retainer 18 against the spring force otherwise.

While one or more embodiments have been described, it is understood that this is capable of modification and that the disclosure is not limited to the precise details set forth but includes such changes and alterations as fall within the purview of the following claims.

What we claim as our invention is:

1. An electrical terminal for forming an electrical connection between a conductor and a current bar, the electrical terminal comprising:

a current bar, a spring retainer, and a spring, the spring retainer not integral with the current bar and not integral with the spring, the spring comprising first and second end portions;

the spring compressed between a first portion of the current bar and a first portion of the spring retainer, the first end portion of the spring in pressure contact with the first portion of the current bar and the second end portion of the spring in pressure contact with the first portion of the spring retainer, the spring urging the spring retainer in a first direction away from the first portion of the current bar;

the spring retainer comprising a first abutment surface facing the first direction, the current bar comprising a first abutment surface facing the first abutment surface of the spring retainer;

the first abutment surface of the current bar disposed to engage the first abutment surface of the spring retainer with movement of the spring retainer in the first direction whereby the first abutment surface of the current bar resists movement of the spring retainer urged by the spring away from the first portion of the current bar.

2. The electrical terminal of claim 1 wherein the first abutment surface of the current bar is located on a second portion of the current bar, the second portion of the current bar joined to the first portion of the current bar by a substantially right-angle bend in the current bar.

3. The electrical terminal of claim 2 comprising a notch defined in the second portion of the current bar, the first abutment surface of the current bar is on a side of the notch, and the first abutment surface of the spring retainer is received in the notch.

4. The electrical terminal of claim 1 wherein the first abutment surface of the current bar is disposed on a notch defined along a peripheral edge of the current bar.

5. The electrical terminal of claim 1 wherein the first portion of the spring retainer is flat and faces the first portion of the current bar.

6. The electrical terminal of claim 5 wherein the spring retainer includes a web, the first portion of the spring retainer forms a first flange extending away from the web, and the web includes a second flange extending away from the web, the first abutment surface of the spring retainer on the second flange.

7. The electrical terminal of claim 6 wherein the second flange of the spring retainer extends along a length of the current bar and is configured to resist relative angular displacement of the spring retainer with respect to the current bar.

8. The electrical terminal of claim 7 wherein the second flange of the retainer extends through a slot formed in the current bar.

9. The electrical terminal of claim 1 wherein the spring is a V-shaped spring.

10. The electrical terminal of claim 1 wherein the retainer is formed from steel.

11. A connector block for forming electrical connection between a conductor and a conductor portion of a current bar, the connector block comprising:

a housing, a current bar, a spring, and a spring plate, the spring plate not integral with the current bar and not integral with the spring;

the current bar, the spring, and the spring plate disposed in the housing;

the spring normally compressed between the current bar and the spring plate, a first end portion of the spring in pressure contact with a contact portion of the current bar and a second end portion of the spring in pressure contact with the spring plate, the spring urging the spring plate away from the contact portion of the current bar;

the current bar comprising an abutment surface facing the retainer, the abutment surface disposed to engage the spring plate and resist movement of the spring plate urged by the spring away from the contact portion of the current bar.

12. The connector block of claim 11 wherein the abutment surface of the current bar is disposed on a second portion of the current bar, the contact portion of the current bar joined to the second portion of the current bar by a substantially right-angle bend in the current bar.

13. The connector block of claim 12 wherein the contact portion of the current bar is a free end portion of the current bar.

14. The connector block of claim 12 wherein the spring plate extends through an opening formed in the second portion of the current bar, the abutment surface of the current bar defining at least a portion of the opening.

15. The connector block of claim 14 wherein the opening in the current bar is formed as a notch formed along a peripheral edge of the second portion of the current bar.

16. The connector block of claim 11 wherein the spring plate comprises a triangular-shaped web having first and second sides, a first flange extending away from the first side, and a second flange extending away from the second side;

the second end portion of the spring is in pressure contact with the first flange, and the abutment surface of the current bar faces the second flange.

17. The connector block of claim 16 wherein the first flange of the spring plate extends along a first wall of the housing and the second flange of the spring plate is disposed between the current bar and a second wall of the housing.

18. The connector block of claim 17 wherein the first flange of the spring plate is received in a notch formed in the first wall of the housing.

19. The connector block of claim 16 wherein the second flange extends along a length of the current bar and is configured to resist relative angular displacement of the spring plate with respect to the current bar.

20. The connector block of claim 11 wherein the housing comprises an outer wall having a first opening into the housing and a second opening into the housing, the first end portion of the spring facing the first opening, the second opening in alignment with the contact portion of the current bar and configured to enable insertion of a conductor adjacent to said conductor portion.

21. The connector block of claim 11 wherein the current bar, spring plate, and spring form a terminal assembly, and the connector block comprises at least one additional terminal assembly.

22. The connector block of claim 11 wherein the housing is a slice housing.

23. The connector block of claim 11 wherein the spring plate is made of steel.

24. The connector block of claim 11 wherein the spring is a V-spring.

* * * * *